US005833560A

United States Patent [19]

Davis et al.

[11] Patent Number: 5,833,560

[45] Date of Patent: Nov. 10, 1998

[54] RACQUETBALL RACQUET

[75] Inventors: Stephen J. Davis, Washington Crossing, Pa.; Richard Janes, Burlington Twp., N.J.; James E. Breneman, III, Bensalem, Pa.

[73] Assignee: Prince Sports Group, Inc., Bordentown, N.J.

[21] Appl. No.: 820,972

[22] Filed: Mar. 19, 1997

[51] Int. Cl.[6] ..... A63B 49/00

[52] U.S. Cl. ..... 473/537

[58] Field of Search ..... 473/516, 524, 473/535, 537

[56] References Cited

U.S. PATENT DOCUMENTS

| | | | |
|---|---|---|---|
| 4,531,738 | 7/1985 | Mortvedt et al. | 473/537 |
| 4,618,148 | 10/1986 | Mortvedt et al. | 473/537 |
| 4,681,319 | 7/1987 | Zilinkas . | |
| 5,014,987 | 5/1991 | Soong . | |
| 5,137,274 | 8/1992 | Soong . | |
| 5,165,687 | 11/1992 | Soong . | |
| 5,251,895 | 10/1993 | Darling . | |
| 5,332,213 | 7/1994 | Klose . | |

FOREIGN PATENT DOCUMENTS

| | | |
|---|---|---|
| 0241393 | 10/1987 | European Pat. Off. . |
| 2240301 | 7/1991 | United Kingdom . |

*Primary Examiner*—William E. Stoll
*Attorney, Agent, or Firm*—White & Case L.L.P.

[57] ABSTRACT

The present invention is a racquetball racquet that is substantially longer than a conventional 21 inch racquet, but which has a maneuverability comparable to existing racquets, and on overall playability exceeding conventional 21 inch racquetball racquets. More particularly, a racquetball racquet comprises a frame having a head portion, a handle connected to the head portion, and stringing. The head portion is a thin-wall, hollow composite tubular member having a minimum weight per unit length, and has a cross-sectional height between 15 and 28 mm, a cross-sectional width between 9 and 13 mm, and defines an egg shape strung surface having a length of at least 14 inches, and preferably between 14 and 15.5 inches, and a strung surface area greater than 95 square inches, and preferably between 100 and 125 square inches. The racquet has an overall length that is substantially greater than 21.0 inches, but less than such length as would result in a strung weight exceeding 250 grams or a mass moment of inertia about the handle end exceeding 23.0 g-m$^2$. Preferably, the overall length is between 21.5 and 22.5 inches, and the weight is under 220 grams.

9 Claims, 4 Drawing Sheets

RACQUETBALL RACQUET

FIELD OF INVENTION

The present invention relates specifically to racquetball racquets.

BACKGROUND OF THE INVENTION

Racquetball racquets over the years have been subject to certain dimensional limits set by the American Amateur Racquet Association (AARA). For example, in 1976–1977, the AARA Rules specified that racquetball racquets may have a maximum head length of 11.0 inches, a maximum head width of 9.0 inches, and a maximum handle length of 7.0 inches. The Rules also specified that the combined length and width not exceed 27 inches. Therefore, most racquets were about 18 inches long and under 9 inches wide.

Mortvedt et al. U.S. Pat. No. 4,531,738 discloses an improved racquetball racquet having a length between 19 and 22½ inches, a width between 9½ and 11½ inches, a weight between 220 and 270 grams, a strung surface length between 12 and 14¾ inches, and a strung surface area between 75 and 100 square inches.

The AARA Rules currently specify a maximum length of 21 inches. This does not prevent racquet manufacturers from making longer racquets either for non-tournament play or in anticipation that the Rules may change, and in fact various racquet companies have tried in the past to introduce racquets that exceed 21 inches in length. Such attempts, however, have not been commercially successful.

Tennis racquets have, of course, long exceeded 21 inches in length. However, tennis and racquetball are far different sports, and the racquet requirements are likewise markedly disparate. Racquetball is played on a 4-walled court that is smaller than a tennis court, with a ball that is smaller, travels faster, and tends to reach an opponent more quickly than a tennis ball. Also, an opponent can, and often needs to, hit the ball after it has rebounded off a sidewall, the rear wall, or the ceiling of the court, and thus the direction of ball travel when struck can vary considerably. And, racquetball requires a swing stroke in which the ball is hit with a snapping action of the wrist. In light of these various requirements, a racquetball racquet needs to be very light and maneuverable, and needs to be designed so that it can be swung in relatively close quarters, and near the wall or floor.

One of the challenges in designing a racquetball racquet is the selection of a desirable combination of playing characteristics in terms of overall weight, swing weight, maneuverability, and power. Reducing weight may make the racquet more maneuverable but sacrifice power. Decreasing the overall length makes it easier to maneuver the racquet and to negotiate the walls and corners of the court. The most desirable swing weight for most racquetball players is normally ascertained through trial and error.

The '738 patent contemplates racquets having an overall length in the range of 19 to 22½ inches. Increasing the length of the racquet over the then conventional 18 inches has proven to improve the performance of the racquet. However, as noted above, racquets having overall lengths within the upper portion of the range disclosed in the '738 patent, i.e., longer than 21 inches, have proven to be less desirable than racquets of 21 inches or less, and have not been marketed successfully. Increasing the length of a racquetball racquet tends to make the racquet heavier and less maneuverable, whereas players have been demanding racquets which are just the opposite, i.e., lighter and more maneuverable.

SUMMARY OF THE INVENTION

The present invention is a racquetball racquet that is substantially longer than a conventional 21 inch racquet, but which has a maneuverability comparable to existing racquets and an overall playability exceeding conventional 21 inch racquetball racquets.

More particularly, a racquetball racquet according to the invention comprises a frame having a head portion, a handle connected to the head portion, and stringing. The head portion is a thin-wall, hollow composite tubular member having a minimum weight per unit length, and has a cross-sectional height between 15 and 28 mm, a cross-sectional width between 9 and 15 mm, and defines an egg shape strung surface having a length of at least 14 inches and a strung surface area greater than 95 square inches. The racquet has an overall length that is substantially greater than 21.0 inches, but less than such length as would result in a strung weight exceeding 250 grams or a mass moment of inertia about the handle end exceeding 23.0 g-m$^2$. Most preferably, the racquet length is less than would cause the strung weight to exceed 220 grams.

In one preferred embodiment, the handle is a molded-in handle so as to have a minimum weight, and preferably directly joins said handle so as to constitute an extension of the head portion. Alternatively, the head portion and handle are joined by a head-handle joint.

In the molded-in handle embodiment, the racquet preferably has a strung weight not exceeding 220 grams. Where a heavier handle is employed, such as a rubber pallet, preferably the weight does not exceed 250 grams. In the case of a heavier handle, the added weight is in the region of the hand, and therefore does not increase appreciably the moment of inertia about the handle.

The racquet may be strung in a conventional manner, so as to have a plurality of main strings extending axially and a plurality of cross-strings extending normal to the racquet axis and interwoven with the main strings. Alternatively, the racquet may have a power ring, as disclosed in commonly owned Davis et al. U.S. Pat. No. 5,562,283.

Most preferably, the racquet is between 21.5 and 22.5 inches in overall length, has a strung surface length between 14 and 15.5 inches, and has a strung surface area between 100 and 125 square inches.

A racquet having the foregoing structure has a longer length, but with a swing weight that is equal to or less than the swing weight of conventional racquetball racquets. Due to the racquet's low overall weight, the racquet is very maneuverable in translation (i.e., when the entire racquet needs to be moved to intercept the ball), and due to its low swing weight remains at least as maneuverable as a conventional racquet when swung in an arc rotation.

The egg shape frame is structurally the most efficient head shape for sports racquets, and by employing such shape as part of the present invention the overall weight of the racquet can be reduced, while retaining good power and control. The use of a molded-in handle allows a further reduction in the overall weight of the racquet. By using such structures as a means to reduce racquet weight, the racquet can be extended in length while maintaining the same maneuverability as conventional racquets.

A longer racquet according to the invention provides a number of playing advantages. For example, the racquet allows a player a greater reach. Also, the racquet provides more power. Because the racquet has the same (or lower) swing weight as a conventional racquetball racquet, a torque from the player's arm will produce the same rotational speed in either racquet. However, for the same rotational speed, the tip speed of the longer racquet according to the invention will be greater. Thus, because the present invention allows the ball to hit the strings at a distance further from the player's wrist than in a conventional racquet, the strings will be moving at a higher speed, and the ball will be struck with greater energy. This advantage would not be realized in the case of a longer racquet of the prior art, because while the strung surface of such racquet would also be located further away from the wrist than a conventional 21 inch racquet, the higher swing weight makes it more difficult to swing the racquet, and thus for the same swing effort the prior art longer racquet would not reach the same rotational speed.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
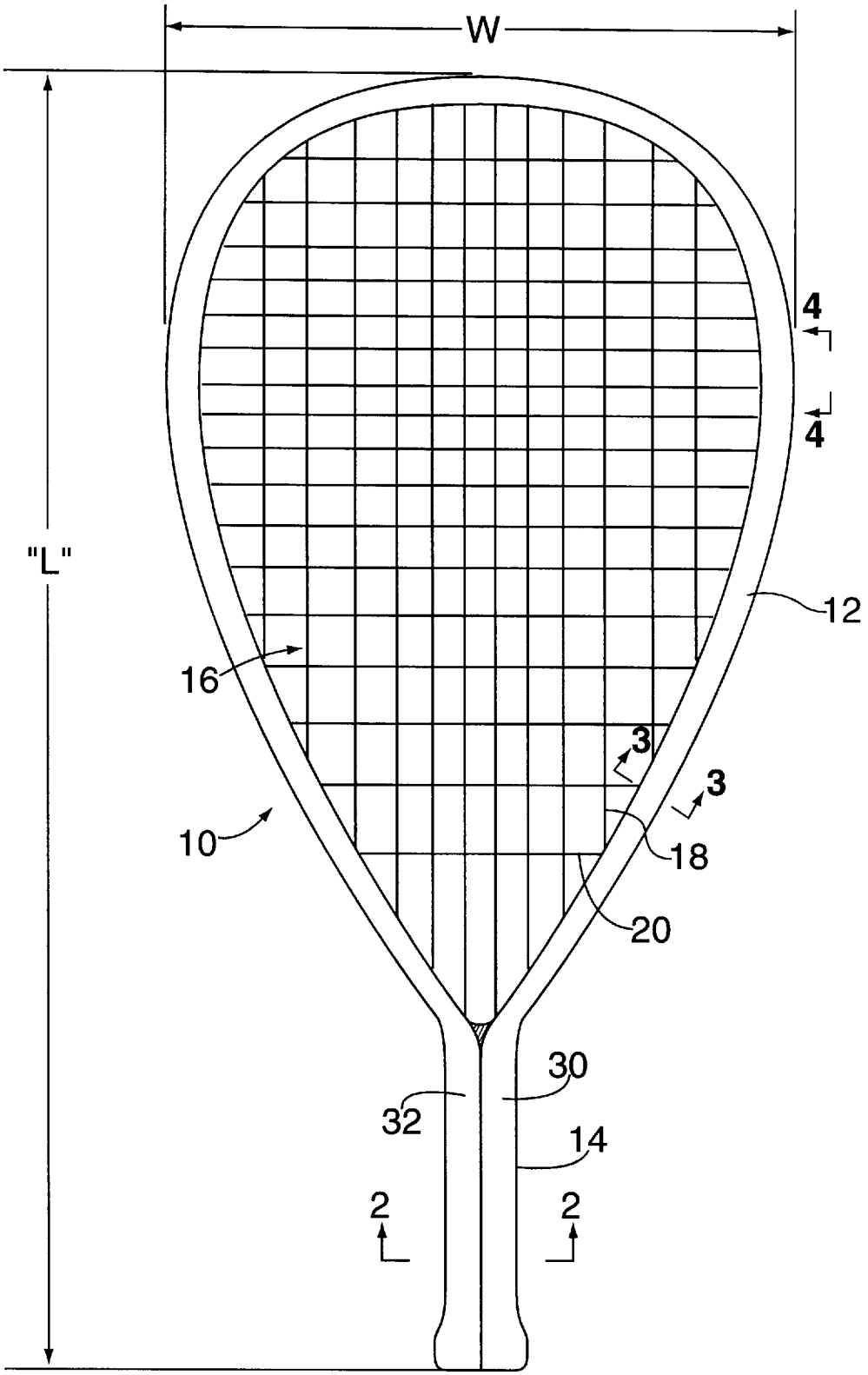
FIG. 1 is a front view of a racquetball racquet according to the invention.

FIG. 1 discloses a racquetball racquet 10 that includes a head portion 12 and a handle 14. The head portion defines an egg shape strung surface 16, containing a plurality of main strings 18 that extend axially, and a plurality of cross-strings 20 that extend perpendicular to the racquet's axis and that are interwoven with the main strings 18.

The strung surface 16 has a length of at least 14 inches and a strung surface area greater than 95 square inches. The racquet has an overall length "L" that is substantially greater than 21.0 inches, but less than such length as would result in a strung weight exceeding 220 grams or a mass moment of inertia about the handle end exceeding 23.0 g-m$^2$. The racquet has a width "w" (at its widest point) between 9 and 11 inches.

Figure 3:
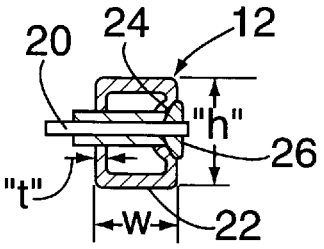
FIG. 3 is a cross-sectional view of the head portion of the racquet, taken through lines 3—3 of FIG. 1.

As shown in FIG. 3, the head portion is formed of a hollow composite tubular frame member 22. The tubular frame member 22 has a wall thickness "t" preferably between 0.5 and 1.5 mm, thereby to have a minimum weight per unit length. The tubular frame member 22 has a cross-sectional height "h" (i.e., in a direction perpendicular to the string bed) between 15 and 28 mm, a cross-sectional width "w" between 9 and 15 mm. The cross-sectional height "h" may be constant along the racquet frame. Alternatively, the height "h" may vary, for example increasing from a minimum, e.g., 15 mm, above the handle to a maximum, e.g., 28 mm, at the tip. Similarly, the cross-sectional width "w" of the frame may either be constant or may vary in a desired manner.

As shown in FIG. 3, the frame member 22 has a conventional stringing groove 24, in which sits a grommet strip 26 for guiding the strings, cross-string 20 being shown, through string holes formed in the frame member 22. The grommet strip also acts as a seat for the portions of the strings 18, 20, that extend along the outer surface of the frame member 22 between string holes.

Figure 4:
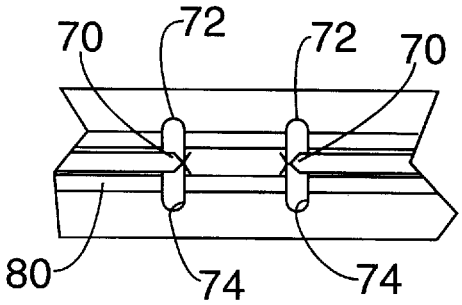
FIG. 4 is a side view of a portion of the racquet frame of FIG. 1, looking in the direction of lines 4—4 of FIG. 1.
Figure 5:
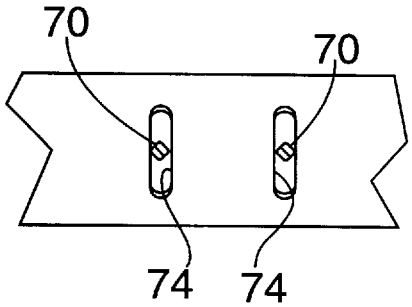
FIG. 5 is an inside view (i.e., looking in the direction opposite of FIG. 4) of the portion of the racquet frame shown in FIG. 4.
Figure 6:
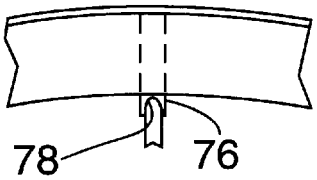
FIG. 6 is a front view.

As shown in FIG. 4–6, preferably the ends of at least some of the cross strings, e.g., strings 70 disposed in the center region of the racquet face, are mounted in notched, slotted grommets 72, rather than with conventional round grommet holes (as in FIG. 3). More particularly, the grommet holes 74 are elongated in a direction perpendicular to the string bed 16, and the inner ends 76 of the grommet pegs have notches 78, disposed at opposed locations perpendicular to the string bed 16. The grommet strip 80 anchors the strings 70 on the outside of the frame, up to the point where the strings 70 enter the grommet holes 74, but the strings 70 are free to move in a direction perpendicular to the string bed 16 within the grommet holes 74. The notches 78 allow additional freedom of movement of the strings 70 at the location where they enter the string bed 16. The use of notched, slotted grommets increases the effective lengths of the strings, as well as providing vibration damping of the strings after ball impact. An example of a notched, slotted grommet system is described more fully in commonly owned U.S. patent application Ser. No. 08/772,411, filed Dec. 23, 1996, the disclosure of which is incorporated herein by reference.

The racquet 10 may be made in accordance with known molding techniques. Typically, a frame tube of uncured epoxy, or "prepreg", which is flexible prior to curing, is placed in a mold having the desired head shape. The ends of the prepreg tube, i.e., below the head, extend side-by-side in the mold in order to form a shaft. An inflatable bladder, disposed within the continuous frame tube, is inflated, while the mold is heated, in order that the prepreg tube assume the shape of the mold and cure. Thereafter, an octagonal shape handle member, such as a resilient handle pallet, is secured over the shaft to form the handle.

Figure 2:
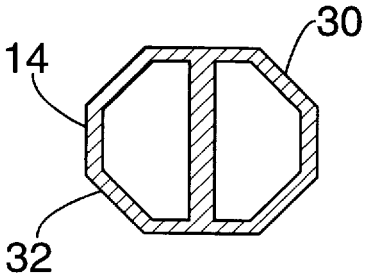
FIG. 2 is a cross-sectional view of the handle of the racquet, taken through lines 2—2 of FIG. 1.

The exemplary embodiment may be made according to such process except that, as shown in FIG. 2, instead of using a handle pallet on a shaft, in the example the racquet 10 has a molded-in handle 14. Methods for forming a molded-in handle are well known. Instead of molding the ends of the prepreg tube into a shaft, the mold is shaped so that the two ends of the tube 30, 32, are molded directly into the shape of an octagonal handle. Thus, the racquet does not need a separate handle or pallet to be mounted on the shaft. A molded-in handle is a means of reducing the weight of the handle, and thereby the overall weight of the racquet. Although the embodiment of FIG. 1 is provided with a molded-in handle, if desired the handle portions of the tube could be molded into a shaft, on which a handle is secured, in the customary manner. In the case of a racquet having a molded-in handle, the strung racquet preferably weighs less than 220 grams. In the case of a racquet having a separate handle pallet, the racquet weighs under 250 grams. In such manner, the added weight of the handle pallet produces only a minimal increase in the moment of inertia about the handle.

Figure 7:
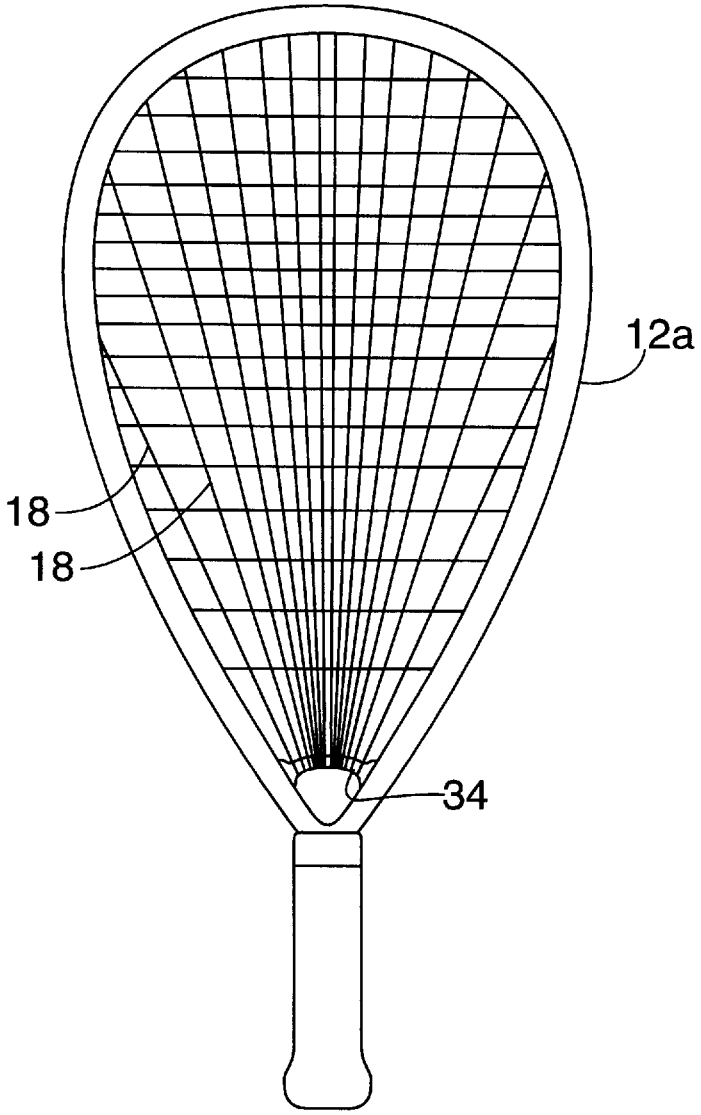
FIG. 7 is a front view of an alternative embodiment of a racquetball racquet.

FIG. 7 discloses an alternative embodiment in which, rather than conventional orthogonal stringing, the lower ends of the main strings 18 are wrapped around a power ring 34, and thus fan out from the handle end, as described more fully in commonly owned Davis et al. U.S. Pat. No. 5,562,283.

Figure 8:
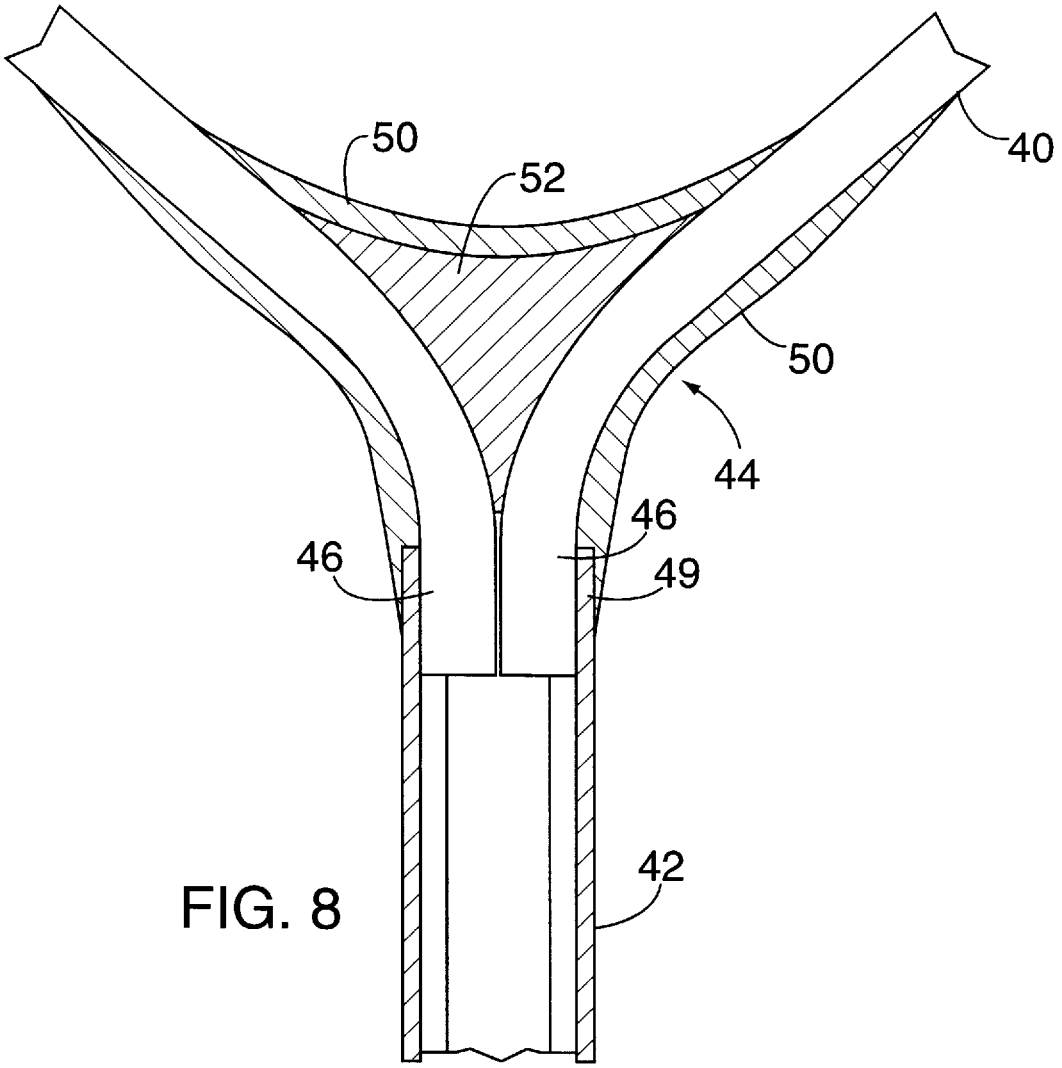
FIG. 8 is a front, sectional view of the throat region of another alternative embodiment.

In the case of FIG. 1, as described above the head 12 and handle are formed from a continuous tube of composite material. FIG. 8 shows an alternative embodiment in which the head portion 40 is formed from a first composite tube, and a handle 42, which is octagonal shape in cross-section, is formed from a separate tube. The head portion 40 and handle 42 are joined together in a throat joint 44, in which the two ends 46 of the head portion 40 are disposed in the upper end 49 of the handle tube 42. Additional composite material 50 is wrapped around the ends 46 and 49, and composite material 52 may also be used to fill in the region above the ends 46.

Figure 9:
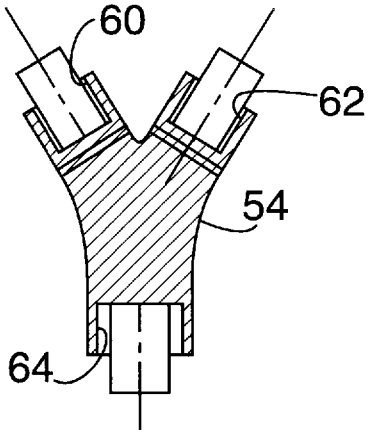
FIG. 9 is a front, sectional view of the throat region of yet another embodiment.

FIG. 9 discloses an alternative embodiment, in which a pre-formed, e.g., plastic or metal, throat joint 54 is used to join the two ends of the head portion (not shown) and the upper end of the handle tube (also not shown). As can be seen in FIG. 9, the joint 54 has a pair of annular slots 60 and 62 that can receive the ends of the head tube frame member, and a third annular slot 64 into which the upper end of the handle tube can be received. A throat joint as shown in FIG. 9 is described more fully in commonly owned Davis U.S. Pat. No. 5,238,247. The embodiments of FIGS. 8–9 provide the ability to make the racquet head and handle out of different materials.

The foregoing represent preferred embodiments of the invention. Variations and modifications will be apparent to persons skilled in the art, without departing from the inventive concepts disclosed herein. All such modifications and variations are intended to be within the skill of the art, as defined in the following claims.

I claim:

1. A racquetball racquet comprising a frame having a head portion, a handle connected to said head portion, and stringing; wherein said head portion is a thin-wall, hollow composite tubular member having a minimum weight per unit length; wherein said head portion has a cross-sectional height between 15 and 28 mm, a cross-sectional width between 9 and 13 mm, and defines an egg shape strung surface having a length of at least 14 inches and a strung surface area greater than 95 square inches; wherein said racquet has an overall length that is substantially greater than 21.0 inches but less than such length as would result in a strung weight exceeding 250 grams or a mass moment of inertia about the handle end exceeding 23.0 g-m$^2$, wherein the ends of at least some of the strings are received in slotted grommets.

2. A racquetball racquet according to claim 1, wherein said racquet has an overall length less than such length as would result in a strung weight exceeding 220 grams.

3. A racquetball racquet according to claim 1, wherein said handle is a molded-in handle and has a minimum weight, and wherein said racquet has an overall length less than such length as would result in a strung weight exceeding 220 grams.

4. A racquetball racquet according to claim 1, wherein said head portion directly joins said handle.

5. A racquetball racquet according to claim 4, wherein said head portion comprises a molded-in handle constituting an extension of said head portion.

6. A racquetball racquet according to claim 5, wherein said head portion and handle joined by a head-handle joint.

7. A racquetball racquet according to claim 1, wherein the racquet is between 21.5 and 22.5 inches in overall length, wherein the length of the strung surface is between 14 and 15.5 inches, and wherein the strung surface area is between 95 and 125 square inches.

8. A racquetball racquet according to claim 7, wherein the strung surface area is between 100 and 125 square inches.

9. A racquetball racquet according to claim 1, wherein the ends of at least some of the strings are received in notched, slotted grommets.

* * * * *